United States Patent [19]

Grant

[11] Patent Number: 4,686,335

[45] Date of Patent: Aug. 11, 1987

[54] SHOCK SENSOR SWITCH

[75] Inventor: John T. Grant, Norwich, England

[73] Assignee: Maximal Security Products Ltd., Croydon, United Kingdom

[21] Appl. No.: 764,884

[22] Filed: Aug. 12, 1985

[51] Int. Cl.[4] ..... H01H 35/14

[52] U.S. Cl. ..... 200/61.45 R; 200/61.51

[58] Field of Search ..... 200/61.45 R, 61.48–61.52, 200/61.83

[56] References Cited

U.S. PATENT DOCUMENTS

| | | | |
|---|---|---|---|
| 2,064,827 | 12/1936 | Gardner | 200/61.51 |
| 2,780,688 | 2/1957 | Stec | 200/61.52 |
| 2,806,914 | 9/1957 | Tedder | 200/61.45 R |
| 3,246,092 | 4/1966 | Todd | 200/61.45 R |
| 3,588,400 | 6/1971 | Fanes | 200/61.45 R |
| 3,835,273 | 9/1974 | Stolarik | 200/61.48 |
| 4,022,997 | 5/1977 | Inagaki et al. | 200/61.45 R |
| 4,399,640 | 7/1982 | Grant | 200/61.45 R |

*Primary Examiner*—J. R. Scott

*Attorney, Agent, or Firm*—Cushman, Darby & Cushman

[57] ABSTRACT

A vibration sensitive switch has a pair of spaced apart parallel contacts (4) housed in a switch body (1,2,3) and a movably supported activated mass (5) inside a chamber (6) in the body. The mass (5) is supported by conductive members in the form of a pair of bars (14, 16) secured in the mass and located between the two contacts (4) with the center of gravity (Cg) of the mass (5) spaced from the points of contact between the contacts (4) and the bars so that bars are urged against the contacts (4) by a lever action as a result of the gravitational force acting on the mass (5). The forces at the contact points are thus greater than that which would be obtained by simply allowing the mass to rest on the contacts, which enables a relatively small mass to be used having a greater sensitivity to high frequency vibrations.

14 Claims, 7 Drawing Figures

SHOCK SENSOR SWITCH

DESCRIPTION OF THE PRIOR ART

The invention relates to a vibration switch, particularly but not exclusively for use, in security systems to detect vibration through building structures during a forcible entry.

The operation of such switches relies on an electrical connection being maintained by means of gravity acting upon a free moving mass connected to or part of the electrical circuit. The body of the switch is normally firmly attached to the building structure. During vibration, the switch body and associated fixed electrical contacts will move, whereas the mass will tend to remain relatively stationary due to inertia effects. During vibration, the electrical circuit will be opened and closed rapidly as the mass loses contact with its points of rest. The electrical signals obtained may be suitably analysed and processed by electronic circuits and provided pre-set conditions are met, be used to signal an alarm condition.

Numerous different switch designs have been proposed but most suffer from certain disadvantages. In many designs, the available pressure from the weight of the mass is used to maintain the electrical contacts closed.

Where there are two contact points, which are usually also the points of rest, the force acting on the contact points is divided equally. Where multiple contact points are used, the force acting on these points is correspondingly reduced. In most designs, hitherto, conflicting requirements are encountered. One requirement is for a small mass so that low frequency vibrations caused by wind or traffic vibrations, will not dislodge the mass from its resting position; whereas high frequency vibrations typically resulting from the release of stored energy when materials are forced beyond their breaking point, will allow the mass inertia to leave the points of rest. Another requirement is for high contact pressure which is needed to overcome oxide and other contamination of the electrical contacts over long periods of time. These two requirements are in conflict in typical currently available designs.

The present invention aims to overcome these conflicting requirements.

SUMMARY OF THE INVENTION

According to the present invention we propose a vibration switch wherein the mass is suspended relative to spaced contacts in the body such that, in an in-use position of the switch, gravity acting on the mass applies a torque urging contact bridging means into a normally closed position. The contact bridging means is, preferably, mounted on the mass and spaced from the centre of gravity thereof to provide leverage and hence a higher contact pressure at the points of rest for example, the points of contact between the bridging means and the spaced contacts, than would be obtained if the centre of gravity of the mass was located somewhere between the points of rest as in conventional switches.

In the preferred embodiment, the contact bridging means comprises spaced conductors so disposed between the spaced contacts as to provide a wedging action to further increase the contact pressure.

The spaced conductors and preferably also the spaced contacts may be circular in cross-section. Further, by arranging the conductors to run at right angles to the contacts desirable so-called "cross-bar" or "cross-point" contact is achieved.

A switch according to the present invention may have relatively light inertia mass whilst providing contact pressure greater than would normally be available using conventional techniques. Further, the switch exhibits improved low frequency rejection by virtue of the low mass, a corresponding reduction in size as compared with existing switches and an increase in contact pressure greater than existing switches currently available.

BRIEF DESCRIPTION OF THE DRAWINGS

An embodiment of the invention will now be described by way of example with reference to the accompanying drawings in which.

DESCRIPTION OF THE PREFERRED EMBODIMENTS

Figure 1A:
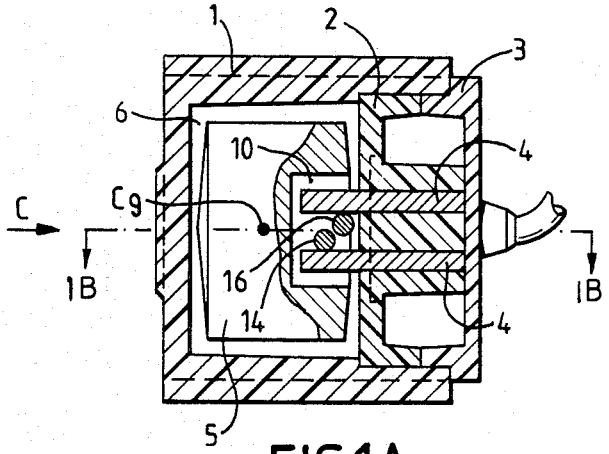
FIG. 1A is a cross-section of a vibration switch in accordance with the invention.
Figure 1B:
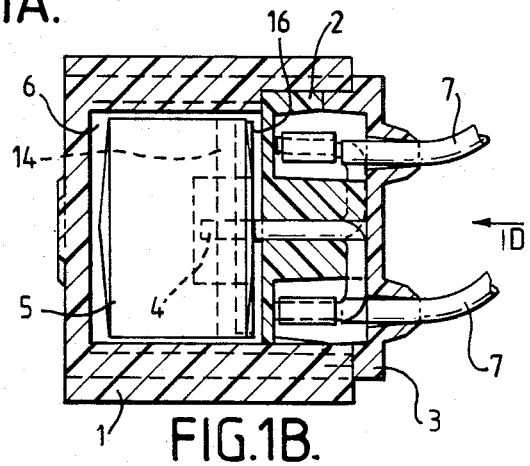
FIG. 1B is a cross-section on 1B—1B in FIG. 1A.
Figure 1C:
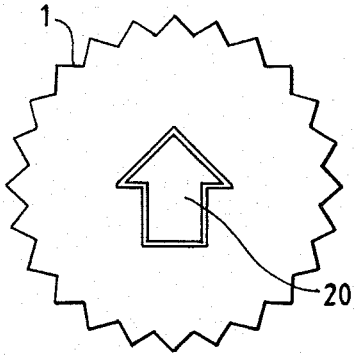
FIG. 1C is an end view on arrow 1C in FIG. 1A.
Figure 1D:
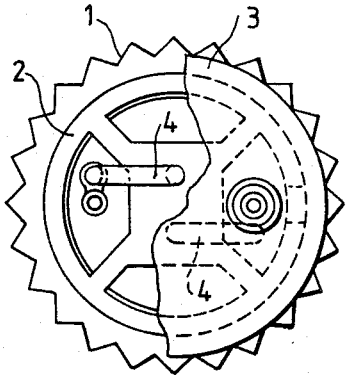
FIG. 1D is an end view on arrow 1D in FIG. 1B partially broken away.
Figure 1E:
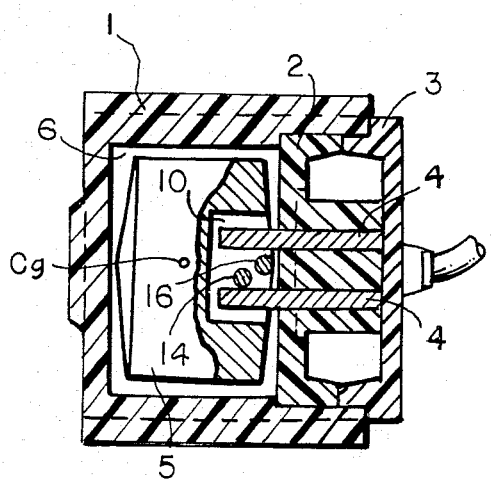
FIG. 1E is a cross-section of the switch in an open position.

The switch shown in FIGS. 1A to 1D, has an outer protective case or housing 1 which is made from an inert and low toxicity thermoplastics material such as polypropylene. In an open end of the housing 1 is fitted an insert 2 supporting a pair of fixed contacts 4 which are connected to lead wires 7 and the insert 2 is held in place by a sealing cap 3. Both the insert 2 and the sealing cap 3 are made of an insulating material such as polypropylene.

Figure 2A:
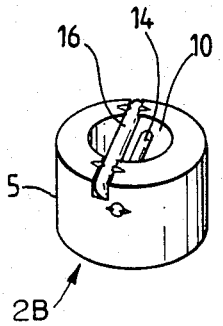
FIG. 2A is a perspective view of the inertia mass of the switch of FIG. 1A.
Figure 2B:
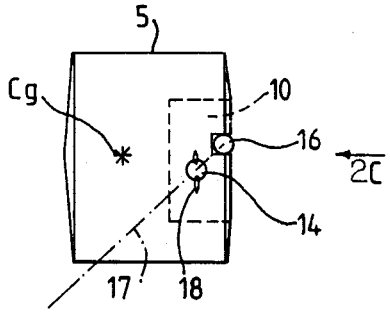
FIG. 2B is an elevation of the inertia mass on arrow 2B in FIG. 2A.
Figure 2C:
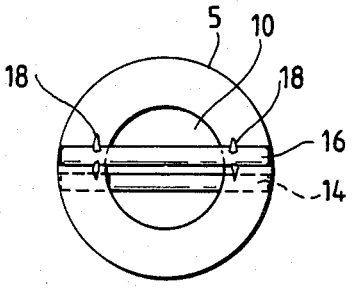
FIG. 2C is an end view of the inertia mass on arrow 2C in FIG. 2B.

An inertia mass 5 of non-ferrous metal is disposed within the chamber 6 defined by the housing 1 and the insert 2 and is suspended on the free ends of the contacts 4 which protrude from the insert 2 into a recess 10 in the mass 5. Contact bridging means in the form of parallel conductors 14 and 16 of circular cross-section extend across the recess 10 parallel to and on opposite sides of a diameter thereof. One conductor 14 is fitted in holes drilled through the walls of the recess 10 and the other conductor 16 is fitted in an open slot in the end face of the mass. Both conductors are retained in position by burrs 18, see FIGS. 2B and 2C, formed in the holes or slots or on the ends of the conductors as appropriate.

By this arrangement, the two conductors 14 and 16 are spaced apart along the axis of the mass 5 preferably such that a line 17 joining the centres of the conductors intersects the axis of the mass at 45°, the distance between tangents to the conductors 14 and 16 parallel to the axis of the mass being substantially equal to the distance by which the fixed contacts 4 are spaced apart and more generally, the distance between the outside of the two conductors, measured along a line joining their centres, is greater than the spacing of the contacts 4.

When the assembled switch is disposed in the in-use position indicated by the arrow 20 on the switch housing 1, such that the axis is generally horizontal, the centre of gravity of the mass Cg is to one side of the contact bridging means so producing a torque tending to tilt the mass about the point of contact between the conductor 14 and the lower fixed contact 4, and hence urge the conductors 16 and 14, respectively into contact with the upper and lower fixed contacts 4.

The pressure at the rest points, for example, the points of contact between the conductors 14 and 16 and the fixed contacts 4, is relatively high for two reasons. Firstly, there is a 4:1 ratio between the centre of gravity and the fulcrum; namely, the point of contact between conductor 14 and the lower fixed contact 4, and the fulcrum and the rest point of the conductor 16. Secondly, the relative axial displacement of the two conductors 14 and 16 provides additional contact pressure due to the wedging action of the conductors 14 and 16 between the fixed contacts 4. The inherent resilience of both the conductors 14, 16 and the contacts 4 permits limited wiping contact which helps to maintain reliable electrical contact.

To improve low contact resistance both the fixed contacts 4 and the conductors 14 and 16 may be coated with gold.

It will be appreciated from the foregoing that the arrangement of contacts and conductors of circular crosssection described above produces desirable "cross-bar" or "cross-point" contact.

I claim:

1. A vibration sensitive switch comprising:

a switch body;

an electrical contact housed in the switch body for connection in an electrical circuit and defining two contact surfaces;

a mass movably supported with respect to the body at a fulcrum position offset from a center of gravity of the mass, whereby gravity applies a turning moment to the mass about said fulcrum position; and contact bridging means, coupled to the mass, for bridging between said two contact surfaces, for changing a state of electrical connection of said electrical contact between make and break under the influence of the turning moment of the mass, wherein, when the switch is in its reset position, the contact bridging means is urged against the contact surfaces by a lever action about said fulcrum position as a result of the gravitational force acting on the mass and, when the switch is subject to vibration, the mass and the switch body undergo relative movement about said fulcrum position to make and break said electrical connection.

2. A switch according to claim 1, wherein the contact bridging means are secured to the mass, and the fulcrum position is laterally spaced from the centre of gravity of the mass whereby gravity applies a turning moment to the mass about said fulcrum position.

3. A switch according to claim 2 wherein the contact bridging means is supported upon one of the two contact surfaces of the electrical contact which defines the fulcrum position.

4. A switch according to claim 2 wherein the contact bridging means includes two contact portions, one of the contact portions being supported upon one of the two contact surfaces of the electrical contact and which defines the fulcrum position.

5. A switch according to claim 4 wherein the electrical contact defines two elongate spaced apart contact surfaces, a line intersecting said contact portions being inclined with respect to at least one of the contact surfaces.

6. A switch according to claim 5 wherein the electrical contact comprise two parallel rods secured in the switch body, and wherein the contact bridging means comprise a pair of parallel bars secured to the mass and oriented substantially at right angles to the rods and engageable therewith.

7. A switch according to claim 6, wherein the switch body defines a chamber which encloses the mass.

8. A vibration sensitive switch for sensing a vibration in a vibration object comprising:

first and second terminal means, opposed to one another and rigidly coupled to said vibration object, each of said first and second terminal means for conducting an electric potential;

inertia containing means for providing a source of high inertia as compared with said first and second terminal means, said inertia containing means formed with an opening into which said first and second terminal means extend, said inertia containing means having a center of gravity spaced from said opening;

a first conductive member, rigidly coupled to said inertia containing means, for forming an electrical contact with said first terminal means, and for providing a fulcrum about which said inertia containing means is movably supported;

a second conductive member for forming an electrical contact with said second terminal means, said second contact bridging means rigidly coupled to said inertia containing means, and including stop surface means for stopping a movement of said inertia containing means;

wherein said inertia containing means is also for conducting an electrical potential between said first and second contact bridging means.

9. A switch as in claim 8 wherein said first and second conductive members are a pair of substantially parallel rods.

10. A switch as in claim 9 wherein said first and second terminal means comprise a pair of substantially parallel plates.

11. A switch as in claim 10 wherein said inertia containing means is substantially in the form of a cylinder.

12. A switch as in claim 11 wherein said first and second conductive members extend substantially parallel to a diameter of said cylinder.

13. A switch as in claim 9 wherein said inertia containing means is in the form of a cylinder which has an axis, and wherein a line between said first and second conductive members form an angle of substantially 45° with said axis.

14. A switch as in claim 8 further comprising a plurality of burrs, each coupled between one of said conductive member and said inertia containing means, for improving an electrical connection therebetween.

* * * * *